United States Patent [19]

Jakobi et al.

[11] 4,342,626

[45] Aug. 3, 1982

[54] COOLING DEVICE FOR COKE DRY COOLING

[75] Inventors: Wilhelm Jakobi, Essen; Bernhard Heinrichs, Wattenscheid; Friedrich Jokisch, Essen, all of Fed. Rep. of Germany

[73] Assignee: Krupp-Koppers GmbH, Essen, Fed. Rep. of Germany

[21] Appl. No.: 230,596

[22] Filed: Feb. 2, 1981

[30] Foreign Application Priority Data

Feb. 7, 1980 [DE] Fed. Rep. of Germany ..... 3004502

[51] Int. Cl.[3] ..... C10B 39/02

[52] U.S. Cl. ..... 202/228

[58] Field of Search ..... 202/228, 227; 201/39, 201/18

[56] References Cited

U.S. PATENT DOCUMENTS 4,141,795 2/1979 Koizumi et al. ..... 201/39

*Primary Examiner*—Norman Yudkoff

*Attorney, Agent, or Firm*—Michael J. Striker

[57] ABSTRACT

A cooling device for coke dry cooling, has a housing composed of upper and lower parts connected with one another by a slide joint, and a ring-shaped insert located inside the upper part of the housing and constituted of a metallic heat-resistant material, coated by a wear-resistant and heat-resistant coating layer. The insert is conical and mounted by its upper end portion on the upper part of the housing.

14 Claims, 2 Drawing Figures

COOLING DEVICE FOR COKE DRY COOLING

BACKGROUND OF THE INVENTION

The present invention relates to a cooling device for coke dry cooling. More particularly, it relates to a cooling device for coke dry cooling, which has an upper part provided with an outlet for gaseous cooling medium, and a ring-shaped insert arranged in the upper part.

The cooling devices of the above-mentioned general type are known in the art. For a long time, these coolingdevices have a construction in which withdrawal of the gaseous cooling medium is performed from the upper part via an annular passage provided in masonry of the cooling device coating. The above-mentioned construction has, first of all the disadvantage in the fact that for brick lining of the annular passage, a great number of bricks with complicated shapes is necessary, and an extremely great quantity of refractory coating material is required for this lining. Moreover, the different thermal expansion between the inner surface and the outer surface of the cooling device during the cooling process leads to very fast damages of the refractory coating. In the above-mentioned construction the damaged coating cannot be repaired or can be repaired with great difficulties and with considerable consumption of time and material.

It was also proposed to provide the cooling device with a ring-shaped insert which extends from above into the interior of the cooling device to the region of the outlet conduit for gaseous cooling medium. Such a construction is disclosed, for example, in FIG. 1 of the German Offenlegungsschrift No. 2,700,783. When hot coke fills the cooling device from above and discharges from the ring-shaped insert, it forms a pile, and a closed annular space remains between the inner side of the cooling device and the outer side of the ring-shaped insert. The outlet conduit for withdrawing the gaseous cooling medium is connected with the cooling device in the region of the above-mentioned annular space, and thereby hot gas escaping from the coke which is being cooled, is withdrawn from the annular space into the outlet conduit. The thus designed cooling device has a simpler construction and provides for improved process of cooling as compared with the first above-mentioned construction. However, it is also not free from disadvantages. The ring-shaped insert together with the conventional cooling coating is completely constituted of refractory brick work. This means that this construction also possesses the above-mentioned disadvantages, though to a smaller extent.

SUMMARY OF THE INVENTION

Accordingly, it is an object of the present invention to provide a cooling device for coke dry cooling, which avoids the disadvantages of the prior art.

More particularly, it is an object of the present invention to provide a cooling device for coke dry cooling, which has a lighter and less complicated construction with a lower consumption of a refractory material.

Another object of the present invention is to provide a cooling device for coke dry cooling in which the necessity to be repaired because of the thermal expansion, especially during heating or cooling of the cooling device, is reduced.

A further feature of the present invention is to provide a cooling device for coke dry cooling, which provides for good controllability of gaseous medium exiting from the coke and thereby favorably influences the flow condition in the cooling device.

In keeping with these objects and with others which will become apparent hereinafter, one feature of the present invention resides, briefly stated, in a cooling device for coke dry cooling, in which a ring-shaped insert is constituted of a heat resistant metallic material provided with an inner wear-resistant and heat-resistant layer, the insert is mounted in a housing of the cooling device by connecting an upper end of the insert with an upper part of the cooling device, and the upper part is connected with a lower part of the cooling device by a slip joint.

It is advantageous when the ring-shaped insert does not have a conventional cylindrical shape, but is conical so as to provide a relatively greater annular space between the inner surface of the device and the outer surface of the ring-shaped insert. The conical shape provides for a relatively good distribution of gaseous cooling medium exiting from the coke over the entire periphery. Moreover, the conical shape allows to provide for smaller structural volume.

If necessary, the cooling device can be provided with means for homogenization and/or throttling the gas flow, arranged in the annular space between the inner surface of the housing of the cooling device and the outer surface of the insert.

The above-mentioned means for homogenization and/or throttling of the gas flow may be held in the housing in the cooling device with the aid of a supporting ring mounted on the ring-shaped insert, and a recess provided in a refractory coating of the housing.

The means for homogenization and/or throttling can be constituted of a heat-resistant metallic material. It also can be constituted of refractory shaped brick, for example of so-called cover brick.

Finally, it is advantageous when a connecting conduit for the outlet opening of the gaseous cooling medium has a round cross-section.

The novel features which are considered as characteristic for the invention are set forth in particular in the appended claims. the invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
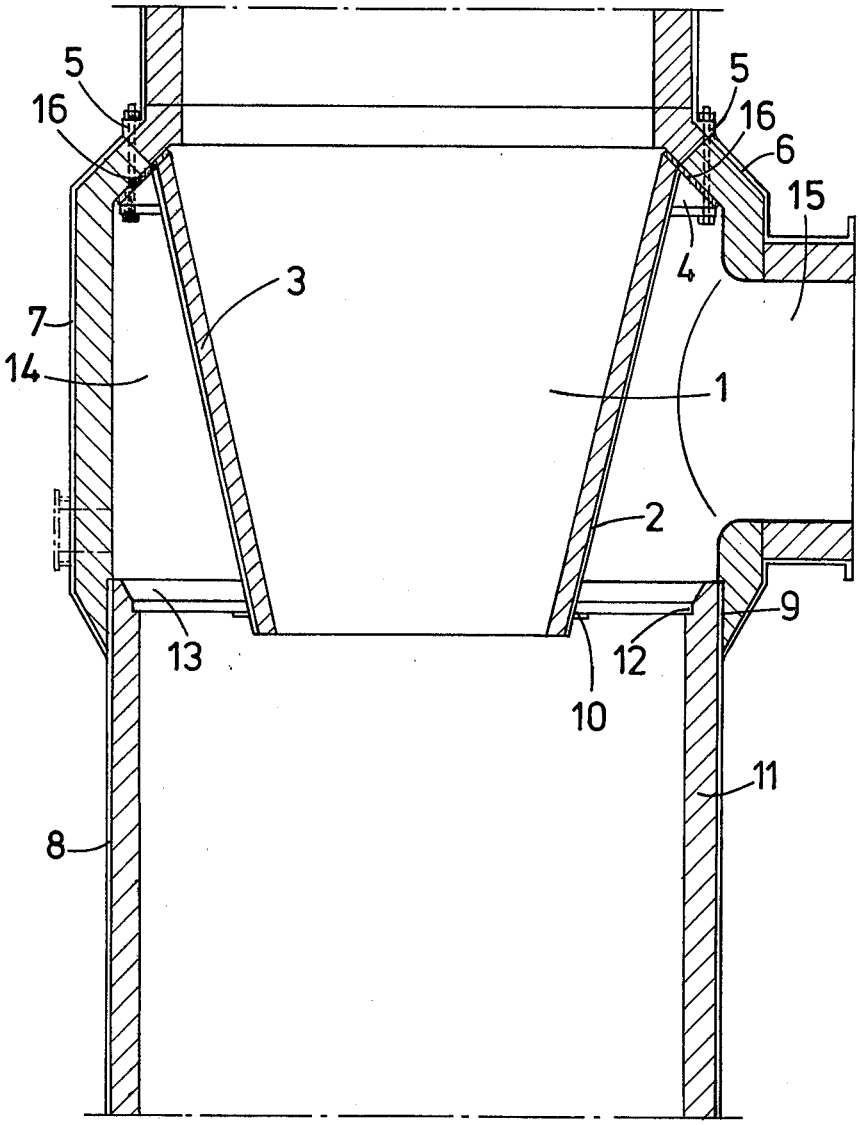
FIG. 1 is a view showing a longitudinal section of a cooling device for coke dry cooling, in accordance with the present invention.
Figure 2:
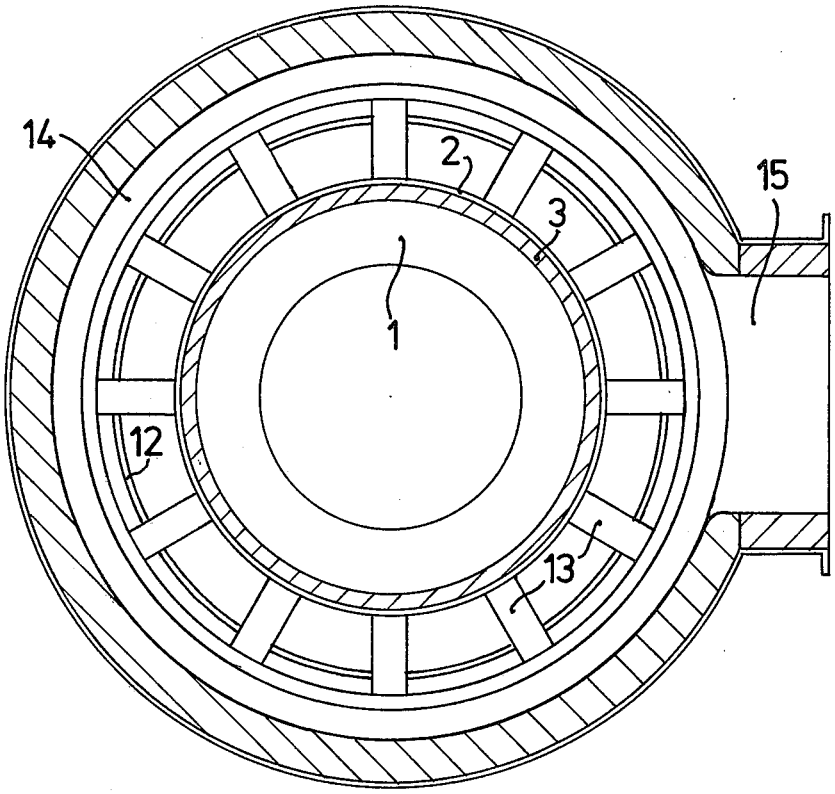
FIG. 2 is a view showing a transverse section of the inventive cooling device of FIG. 1.

A cooling device in accordance with the present invention is shown in the drawing. Some parts of the cooling device which are known per se in the art and not germaen to the present invention are not shown. For example, a feeding arrangement for feeding coke to be cooled at the upper end of the cooling device and a discharging arrangement for discharging the cooled coke at the lower end of the cooling device, as well as a gas inlet are not shown in the drawing. It is to be understood that the present invention deals with a cooling device in which coke to be cooled is supplied in known manner from above downwardly, and a gaseous cooling medium is supplied from below upwardly in a rising counterflow to the flow of the coke. The respective parts of the cooler are sealed by not shown sealing means.

The cooling device in accordance with the present invention has a housing composed of an upper part identified by reference numeral 7 and a lower part identified by reference numeral 8. A ring-shaped insert 1 is arranged inside the housing. The insert 1 has a conical wall 2 which is constituted of a heat-resistant metallic material, for example of heat resistant steel. A layer 3 is arranged on the inner surface of the conical wall 2 for protecting the same from wear and heat.

The layer 3 can be constituted of a refractory brick or a refractory spring mass or stamping mass. It is also possible to apply this layer by so-called flame spraying. The layer 3 must not only be formed as a completely homogeneous protective layer. Instead, it may be interrupted, for example, it may be formed by two superimposed layers with different material properties. For example, the layer 3 may be composed of two partial layers, of which the upper layer has an especially high wear-resistance, whereas the other partial layer located underneath the first mentioned partial layer has a very good insulating property.

The ring-shaped insert 1 is mounted in the housing with the aid of a ring-shaped console 4 which is connected with an outer wall 6 by anchoring elements 5. Gas tight sealing element 16 is arranged between the upper edge of the conical wall 2 or the console 4 and the outer wall 6. The gas-tight sealing element 16 provides for a certain heat insulation of the wall 6.

Contrary to the known constructions in which the housing of the cooling device is formed by the throughgoing outer wall 6, the cooling device in accordance with the invention is composed, as mentioned hereinabove, from the upper part 7 and the lower part 8 which are connected with one another by a slide joint 9. The upper part 7 has an inner diameter which corresponds to the outer diameter of the lower part 8, so that during cooling of the cooling device the lower part 8 can freely expand into the upper part 7 without undesirably affecting the position of the latter in the respective mass. The slide joint 9 is also arranged so as to provide the same condition when, during cooling, the upper part 8 is subjected to contraction.

The ring-shaped inset 1 is suspended in the above-described manner on the console 4. Thereby, the position of the ring-shaped insert 1 is influenced only by the vertical thermal expansion which takes place in the region of the console 4. On the other hand, the thermal expansion of the lower part 8 has no influence upon the position of the ring-shaped insert 1.

The conical wall 2 of the ring-shaped insert 1 is provided with a supporting ring 10. On the other hand, the housing of the cooling device is provided with a coating 11 which has a recess 12 at the height of the supporting ring 10. The supporting ring 10 and the recess 12 allow to support in a simple way inserts 13 for homogenization and/or throttling of the flow of gaseous cooling medium. The inserts 13 can be composed of so-called cover bricks or similar refractory shaped brick material. The inserts 13 can be loosely laid on the supporting ring 10 and in the recess 12. It is to be understood that the inserts 13 are distributed uniformly over the entire cross-section of the annular space between the conical wall 2 and the coating 11.

The operation of the above-described cooling device can be shortly explained in the following manner. Coke to be cooled is supplied from above downwardly into the housing of the cooling device. When the coke passes through the ring-shaped insert 1 and exits from the latter, it forms a pile which extends from the coating 11 to the lower edge of the conical wall 2. A closed annular space 14 is formed above the not shown pile of the coke to be cooled. Hot gas which exits from the coke can collect in the annular space 14, and the inserts 13 provide for a uniform distribution or throttling of the gas flow. A connecting pipe 15 opens into the annular space 14 and communicates with a not shown withdrawing conduit. The hot gas is withdrawn from the annular space 14 through the pipe 15 and the above-mentioned conduit and respective heat recovery can be further provided. On static grounds, the connecting pipe 15 has preferably a round cross-section.

The hatched areas in the drawing show the coating of the cooling device. It has been shown that when the cooling device is designed in accordance with the invention, more than 50% of refractory material utilized in conventional cooling devices can be spared. The inventive slide joint 9 considerably reduces the necessity to repair the cooling device because of compression and expansion cracks in the refractory material of the coating. If the cracks take place, the repair can be made relatively easily and with a relatively small expense, inasmuch as the inventive cooling device has a simple construction, it is easily accessible, and only a small number of bricks for coating is required.

It will be understood that each of the elements described above, or two or more together, may also find a useful application in other types of constructions differing from the types described above.

While the invention has been illustrated and described as embodied in a cooling device for coke dry cooling it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cooling device for coke dry cooling, comprising a housing having an upright axis and including an upper hollow part and a lower hollow part connected with one another, said upper part having an outlet opening for withdrawing a gaseous cooling medium; a separate ring-shaped insert arranged inside said upper part of said housing and being constituted of a metallic heat-resistant material, said insert having an inner surface and an upper end portion; means for protecting said insert from wear and heat and including a wear-resistant and heat-resistant coating arranged on said inner surface of said insert; means for holding said insert in said housing and including mounting means arranged to mount said upper end portion of said insert on said upper part of said housing; and means for connecting said upper part with said lower part of said housing, said connecting means including a sliding joint provided between said upper part and said lower part.

2. A cooling device as defined in claim 1, wherein said ring-shaped insert is conical.

3. A cooling device as defined in claim 2, wherein said ring-shaped insert has a cross-section which decreases in direction from above downwardly.

4. A cooling device as defined in claim 1, wherein said insert has an outer surface, said housing having an inner surface facing toward said outer surface of said insert and bounding an annular space together with the latter; and further comprising means for acting upon the gaseous cooling medium, arranged in said annular space.

5. A cooling device as defined in claim 4, wherein said acting means is arranged for homogenization of the gaseous cooling medium.

6. A cooling device as defined in claim 5, wherein said acting means is also arranged for throttling the gaseous cooling medium.

7. A cooling device as defined in claim 4, wherein said acting means is arranged for throttling of the gaseous cooling medium.

8. A cooling device as defined in claim 4, wherein said acting means is constituted of a metallic heat-resistant material.

9. A cooling device as defined in claim 4, wherein said acting means is constituted of a refractory shaped brick material.

10. A cooling device as defined in claim 4, wherein said acting means is constituted of a heat-resistant metallic material and refractory shaped brick material.

11. A cooling device as defined in claim 4; and further comprising means for supporting said acting means, said supporting means including a recess formed in said housing and receiving at least a portion of said acting means, and a supporting ring arranged to support said acting means so that the latter is loosely arranged in said housing.

12. A cooling device as defined in claim 11, wherein said housing has an inner surface provided with an inner coating, said recess being formed in said inner coating of said housing.

13. A cooling device as defined in claim 1, wherein said supporting ring is mounted on said ring-shaped insert.

14. A cooling device as defined in claim 1; and further comprising an outlet conduit communicating with said outlet opening of said upper part of said housing, said outlet conduit having a round cross-section.

* * * * *